US008187058B2

(12) United States Patent
Blickle et al.

(10) Patent No.: US 8,187,058 B2
(45) Date of Patent: May 29, 2012

(54) POWER-DRIVEN HAND TOOL

(75) Inventors: Juergen Blickle, Goeppinger (DE); Uwe Frueh, Sonnenbuehl (DE)

(73) Assignee: C. & E. Fein GmbH (DE)

( * ) Notice: Subject to any disclaimer, the term of this patent is extended or adjusted under 35 U.S.C. 154(b) by 955 days.

(21) Appl. No.: 12/175,766

(22) Filed: Jul. 18, 2008

(65) Prior Publication Data

US 2009/0023371 A1 Jan. 22, 2009

(30) Foreign Application Priority Data

Jul. 19, 2007 (DE) ..... 10 2007 035 045

(51) Int. Cl.
*B24B 23/02* (2006.01)

(52) U.S. Cl. ..... 451/342; 451/359

(58) Field of Classification Search ..... 451/342, 451/357, 359

See application file for complete search history.

(56) References Cited

U.S. PATENT DOCUMENTS

| | | | | |
|---|---|---|---|---|
| 4,597,227 | A | 7/1986 | Gentischer et al. | |
| 4,989,374 | A | 2/1991 | Rudolf et al. | |
| 5,157,873 | A | 10/1992 | Rudolf et al. | |
| 5,199,223 | A | 4/1993 | Rudolf et al. | |
| 5,263,283 | A | 11/1993 | Rudolf et al. | |
| 5,601,483 | A | 2/1997 | Rudolf et al. | |
| 5,718,621 | A * | 2/1998 | Turley | 451/342 |
| 7,013,987 | B2 * | 3/2006 | Nock et al. | 173/213 |
| 7,344,435 | B2 * | 3/2008 | Pollak et al. | 451/342 |
| 7,387,563 | B2 | 6/2008 | Allemann et al. | |

FOREIGN PATENT DOCUMENTS

| | | | |
|---|---|---|---|
| DE | 3431901 | A1 | 3/1986 |
| DE | 4122320 | A1 | 1/1992 |
| DE | 4103501 | A1 | 7/1992 |
| DE | 102004020982 | A1 | 11/2005 |
| EP | 0152564 | A2 | 8/1985 |
| EP | 0319813 | A2 | 6/1989 |
| EP | 0495181 | A1 | 7/1992 |
| EP | 0650805 | A1 | 5/1995 |
| EP | 1302286 | A1 | 4/2003 |
| EP | 1745890 | A1 | 1/2007 |
| WO | 2005102605 | A1 | 11/2005 |

* cited by examiner

*Primary Examiner* — Maurina Rachuba
(74) *Attorney, Agent, or Firm* — St. Onge Steward Johnston & Reens LLC

(57) ABSTRACT

A power-driven hand tool comprises a drive spindle adapted to drive a tool, that can be driven to oscillate about its longitudinal axis, which tool can be fixed on a retaining section of the dive spindle by a securing element, and further comprises a displacing device that serves to displace the securing element between a releasing position in which the securing element can be released from the drive spindle and a clamping position in which the securing element is clamped on the retaining section by a spring element, the securing element comprising a clamping shaft adapted to be inserted into the securing element, which is axially fixed in the drive spindle for clamping the tool in the clamping position, and which can be detached in the releasing position. For clamping of the tool a split chuck is provided which is clamped on the retaining section by the securing element in the clamped position and is connected with the retaining section in form-locking engagement.

20 Claims, 1 Drawing Sheet

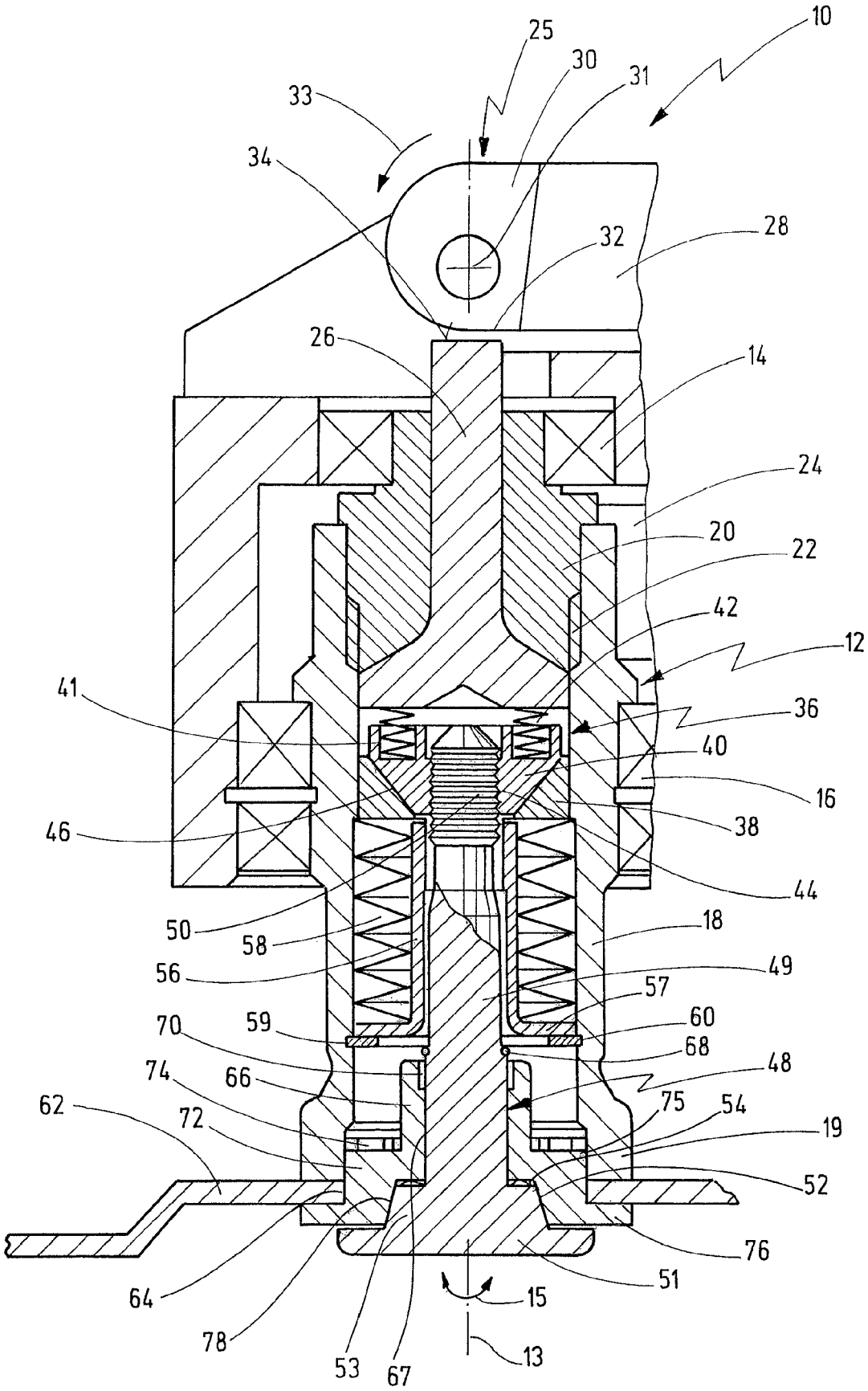
10
25
30
31
33
34
32
28
26
14
24
20
22
42
12
41
36
40
16
46
38
44
50
58
18
56
49
57
59
60
70
68
48
74
66
75
54
62
72
19
52
76
51
64
15
78
13
53
67

POWER-DRIVEN HAND TOOL

BACKGROUND OF THE INVENTION

The present invention relates to a power-driven hand tool having a motor-operated drive spindle, adapted to drive a tool which can be fixed on a retaining section of the drive spindle by a securing element, comprising a displacing device that serves to displace the securing element between a releasing position in which the securing element can be released from the drive spindle and a clamping position in which the securing element is clamped on the retaining section by a spring element, the securing element comprising a clamping shaft adapted to be inserted into the securing element, which shaft is axially fixed in the drive shaft in the clamping position, for clamping the tool, and can be detached in the releasing position.

A power-driven hand tool of that kind is known from U.S. Pat. No. 7,344,435 which is fully incorporated by reference herewith.

In the case of the known hand tool, a securing element can be introduced into the drive spindle through a mounting opening of the tool, and can be clamped in the spindle for clamping and fixing the tool on the retaining section of the drive spindle in form-locking engagement.

A clamping device of that kind is adequate for clamping a tool in many applications. However, it has been found that the forces that can be produced by the known clamping device, under the action of high clamping forces, will as a rule not suffice to withstand very high loads of the kind encountered especially in sawing tools and cutting tools with oscillatory drives.

Other clamping devices intended to clamp tools on power-driven hand tools, without the aid of any auxiliary tool, have been known from DE 41 22 320 A1 and EP 0 152 564 B1. The arrangements described by those patents comprise a drive shaft of hollow design, a spindle seated in that shaft and comprising a displacing device and a clamping point formed by a central securing element or a flange that can be clamped on the drive shaft using the displacing device. Form-locking engagement between the securing element and the drive shaft may be provided in this case to prevent the tool from getting detached by braking effects.

However, the described clamping devices are designed exclusively for electric tools with rotary drives. Electric tools with oscillating drives cannot be clamped.

SUMMARY OF THE INVENTION

In view of this it is a first object of the present invention to provide a power-driven hand tool of the above-mentioned kind whose drive spindle can be driven to oscillate about its longitudinal axis, which provides for safe clamping of the tool on the drive spindle without the aid of any auxiliary tools.

It is a second object of the invention to disclose a power-driven hand tool which allows for an easy removal of the tool for tool changes.

It is a third object of the invention to disclose a power-driven hand tool which is to accommodate the high loads of the kind encountered in tools with oscillatory drives.

These and other objects of the invention are achieved by a power-driven hand tool of the before-mentioned kind in that for clamping the tool on the retaining section a split chuck is provided which is clamped on the retaining section by the securing element in the clamped position, and in that the outer surface of the split chuck has a design, preferably of polygonal shape, adapted to support the tool in the area of its mounting opening in form-locking engagement.

The object of the invention is perfectly achieved in this way.

By using a split chuck for clamping the tool on the retaining section and due to the form-locking engagement between the split chuck and the tool, the invention achieves a clearly higher clamping force compared with conventional clamping systems. Further, the form-locking engagement between the split chuck and the tool guarantees safe transmission of torques even in highly loaded machines with oscillatory drives.

According to an advantageous further development of the invention, the engagement between the securing element and the split chuck is configured so that in the clamping position form-locking element of the split chuck is urged by the securing element against a form-locking counter-element of the drive spindle.

That feature provides the advantage that the form-locking connection between the split chuck and the drive spindle, which always has a certain play for handling reasons, is further reinforced by an absolutely close form-locking connection in the clamping position. This permits even higher torques to be transmitted without any disadvantageous effects such as heating-up of the tool by slippage, or expansion of the tool at its mounting opening.

According to a further development of that embodiment, the securing element comprises a section with an inclined surface the whole extent of which engages the split chuck by a correspondingly adapted inner surface.

The section of the securing element that engages the split chuck can be given a substantially conical shape for this purpose.

This measure results in an even closer form-locking connection between the split chuck and the drive spindle so that a perfect form-locking connection is guaranteed in the clamping position.

According to another embodiment of the invention, a spring element is provided between the split chuck and the securing element.

This feature has the effect to facilitate the operation of releasing the securing element from the split chuck after transfer of the displacing device to the releasing position.

According to a further embodiment of the invention, the split chuck can be connected with the retaining section in form-locking engagement.

This feature improves the transmission of high torques to the tool in the case of highly loaded tools with oscillatory drives.

According to another embodiment of the invention, the split chuck is retained on the clamping shaft of the securing element and is connected with the securing element to a single unit, for common removal from the drive shaft in the releasing position.

The fact that the securing element and the split chuck are thus combined to a single unit makes handling easier during removal from and fitting on the drive shaft.

According to another embodiment of the invention, form-locking elements are provided on the securing element that coact with movable clamping pieces for securing the securing element in form-locking engagement in the clamping position.

The use of form-locking elements guarantees with even greater safety that the clamping effect will not be released under high loads.

According to another embodiment of the invention, radially movable clamping pieces are provided.

This allows a high clamping force to be achieved.

According to a further development of that embodiment, a sleeve is received in the drive spindle on which the clamping pieces are retained for radial displacement.

This feature permits a clamping force applied by a spring element in radial direction to be converted to a radial retaining force that fixes the shaft on the drive spindle, in a reliable and robust way.

Preferably, the clamping pieces are pre-stressed by the spring element toward the form-locking elements in a radial direction toward the center.

This again helps fixing the clamping shaft on the drive shaft.

According to another embodiment of the invention, the clamping pieces are retained in recesses of the sleeve.

This permits easy assembly and safe movement of the clamping pieces between the clamping position and the releasing position.

According to a particularly preferred embodiment of the invention, the sides of the clamping pieces that face the tool are provided with inclined surfaces that coact with inclined surfaces on the sleeves in such a way that any movement of the sleeve relative to the inclined surfaces of the clamping pieces will urge the clamping pieces toward the center.

This provides advantageous conversion of an axial pre-stress, produced by spring force, to a retaining force for fixing the securing element in axial direction.

According to a further embodiment of the invention, the sleeve is axially pre-stressed by the spring element toward the closed position.

According to another embodiment of the invention, an ejector in the form of a sleeve, fixed on the drive spindle in axial direction, is provided on the drive spindle for limiting any axial movement of the clamping pieces on the side of the tool.

This feature ensures safe opening of the clamping pieces when the securing element is to be pulled off the drive spindle together with the split chuck in the releasing position, for tool changes.

At the same time, the spring element permits a high clamping force to be transmitted to the split chuck. Preferably, the dimensions of the spring element should be such that the highest possible clamping force, sufficient for all applications, is achieved. The spring element may be configured as a cup-spring assembly, for example, although other spring types are imaginable as well.

It is understood that the features of the invention mentioned above and those yet to be explained below can be used not only in the respective combination indicated, but also in other combinations or in isolation, without leaving the scope of the invention.

BRIEF DESCRIPTION OF THE DRAWING

Further features and advantages of the invention will become apparent from the description that follows of a preferred embodiment of the invention, with reference to the drawing. In the drawing:

FIG. 1 shows a simplified, sectional representation of a hand tool according to the invention illustrating an oscillatory drive in the region of the operating head, in a clamping position.

DETAILED DESCRIPTION OF THE PREFERRED EMBODIMENT

FIG. 1 shows a sectional view of the operating head area of a power-driven hand tool according to the invention, indicated generally by reference numeral 10. The hand tool 10 comprises a drive shaft 12 with a tool 62 mounted on its outer end using a clamping element that will be described in more detail hereafter.

The drive spindle 12 is driven to oscillate by an eccentric-driven oscillating fork 24, in a manner not shown in detail. As is indicated by double-arrow 15, the drive spindle 12 is moved about its longitudinal axis 13 at a high frequency of between approximately 10,000 and 25,000 oscillations per minute and a small oscillating angle of between approximately 0.5 and 7°.

Such hand tools 10, which are driven to oscillate, have recently come into use in many applications for carrying out special operations, including for example the operation of cutting out motor vehicle panes using an oscillating cutter, sawing using oscillating saw knives, grinding and many more.

In contrast to the conditions encountered with rotary drive spindles, high abrupt torques showing high dynamics are encountered in oscillating drive spindles in both senses of rotation. With the result that high clamping forces (combined with a relatively small size) and a robust close mechanical structure are required to guarantee that the tools will remain fixed to the drive spindle under all operating conditions.

These requirements are met, in the case of the hand tool 10 according to the invention, with the aid of a unique clamping system which simultaneously allows quick clamping and releasing of a tool 62 without the aid of any auxiliary tools.

The drive shaft 12 has a two-part design in that embodiment and comprises a spindle tube 18 which is screwed to a spindle end 20 via a thread 22. The drive spindle 12 is seated in a bearing 14 at its upper end, in the area of the spindle end 20, and in a bearing 16 at its lower end, in the area of the spindle tube 18.

For mounting the tool 62 on the outer end of the spindle tube 18, there is provided a split chuck indicated generally by reference numeral 66, which engages a mounting opening 64 of the tool 62 in form-locking fashion. Further, the split chuck 66 is connected in form-locking engagement with the spindle tube 18 and is clamped on the drive spindle 12, in the clamping position illustrated in FIG. 1, by a securing element 48 so that the tool 62 is clamped by the split chuck 66 on a retaining section 19 at the outer end of the spindle tube 18.

The securing element 48 comprises a clamping shaft 49 which, in the clamping position illustrated in the drawing, can be fixed in a sleeve 38 in form-locking engagement inside the spindle tube 18 using clamping pieces 40 of a locking device indicated generally by reference numeral 36.

The clamping force is applied in this case by a spring element in the form of a cup-spring assembly 58 which is held inside the spindle tube 18 between a locking washer 59 engaging an annular groove 60 and the locking device 36. The tension of the cup-spring assembly 58 has the result to firmly clamp the tool 62 between the retaining section 19 of the spindle tube 18 and the split chuck 66.

In order to permit rapid tool changes without the aid of any auxiliary tools, the locking device 36 can be axially displaced between a clamping position and a releasing position, as illustrated in FIG. 1. The locking device 36 is held for this purpose by spring force between a thrust piece 26 and the cup-spring assembly 58. In the clamping position, the thrust piece 26 is in form-locking engagement with a correspondingly shaped recess in the spindle end 20, projecting by its cylindrical shaft in downward direction through a central bore in the spindle end 20.

The displacing device 25 comprises an eccentric 30 that can be pivoted about an axis 31 of the eccentric by a clamping lever indicated at 28 in FIG. 1.

In the clamping position illustrated in FIG. 1, a spacing exists between the outer end face 34 of the thrust piece 26 and the opposite pressure surface 32 of the eccentric 30. Accordingly, in the clamping position, the thrust piece 26 and, thus, the entire drive spindle 12, are decoupled from the displacing device 25 so that no frictional forces can be transmitted to the drive spindle 12 during operation.

However, when the clamping lever 28 is pivoted from its clamping position illustrated in FIG. 1 to the front in the direction of arrow 33 and into a releasing position, the pressure surface 32 of the eccentric 30 will get into contact with the end face 34 of the thrust piece, thereby displacing the thrust piece 26 against the action of the cup-spring assembly 58 toward the tool 62 with the result that the locking device 36 is displaced to the outside to release the securing element 48, as will be described in more detail hereafter.

The sleeve 38 of the locking device 36 has an annular design and is received within the inner surface of the spindle tube 18 in sliding relation. The end face of the sleeve 38 on the tool side acts as support for the cup-spring assembly 58. The inner surface of the sleeve 38 is configured as an inclined, conical oblique surface 46.

The sleeve 38 coacts with three clamping pieces 40 retained in correspondingly shaped recesses in the sleeve 38. The clamping pieces 40 are each provided with an inclined surface on their side facing the tool 62, and as that surface has the same inclination as the inclined surface 46, they can move along the sleeve 38 in axial and at the same time in radial direction. The sides of the clamping pieces 40 that face toward the center are each provided with a toothing 44 that coacts with a correspondingly shaped toothed section 50 on the clamping shaft 49 of the securing element 48.

The sides of the clamping pieces 40 facing the thrust pieces 26 are each provided with an axial bore 41 that accommodates a spring 42 designed, for example, as a helical spring which serves to urge the clamping pieces 40 toward the tool 62.

The sleeve 38 is screwed to the thrust piece 26 using screws not shown in the drawing. The screws are screwed into matching threaded bores in the sleeve 38 through correspondingly shaped bores in the thrust piece 26. That two-part design serves to mount the thrust pieces 40 in matching recesses in the sleeve 38.

The structure of the locking device 36 and of the associated displacing device 25 is known as such and corresponds to the structure known from U.S. Pat. No. 7,344,435 which is incorporated by reference.

However, contrary to U.S. Pat. No. 7,344,435 the spring element 58 is not designed as a helical spring but rather as a cup-spring assembly 58 and is supported, on the side of the tool, on the locking washer 59 while being in contact with the sleeve 38 on the opposite side. An ejector 56 in the form of a sleeve is enclosed by the cup-spring assembly 50 and is in contact with the locking washer 59 by a flange section 57 on its end facing the tool.

Contrary to the before-mention known arrangement, the securing element 48 does not directly engage the tool 62 by a head portion 51, but engages a correspondingly shaped recess 78 of the split chuck 66 by a conical section 53 so that the split chuck 66 is clamped directly on the tool 62 and, thus, on the retaining section 19 by the securing element 48 via a flange section 76.

The outer portion of the spindle tube 18 is provided on its inner surface with a polygonal section 74 in the form of a dodecahedron. The split chuck 66 comprises a hexagon-shaped polygonal section 72 that follows the flange section 76 and engages the polygonal section 74 of the spindle tube 18 in form-locking fashion.

Accordingly, in the clamping position illustrated in FIG. 1, the split chuck 66 has its polygonal section 72 retained in the polygonal section 74 of the spindle tube 18 in form-locking engagement.

Now, as the conical section 53 of the securing element 48 engages the correspondingly shaped recess 78 of the split chuck 66, under the action of the strong cup-spring assembly 58, the split chuck 66 tends to be slightly expanded in outward direction, in the area of the polygonal section 72, being thereby urged into the polygonal section 74 of the spindle tube 18 so that any play, that may be required for introducing the split chuck 66 into the spindle tube 18, is completely eliminated.

One thus obtains an extremely strong form-locking connection between the split chuck 66 and the spindle tube 18.

At the same time, the mounting opening 64 of the tool 62, having a hexagonal configuration, is held on the polygonal section 72 of the split chuck 66 in form-locking fashion.

This generally provides a very good close form-locking engagement between the split chuck 66, the tool 62 and the spindle tube 18.

As a result, a very high clamping force, provided by the cup-spring assembly 58, can act on the tool 62 so that high torsional moments of alternating directions, produced by the oscillatory drive, can be transmitted without any problem.

The split chuck 66 comprises a central cylindrical bore 67 which is retained on the clamping shaft 49 when the locking device 36 is released, while being allowed to slide axially by a certain amount.

The securing element 48 and the split chuck 66 are undetachably connected to a single unit, for example by an 0 ring 68 that can be inserted a certain amount into a groove 70 in the inner surface of the split chuck 66.

For changing the tool 62, the clamping lever 28 is moved in the direction indicated by arrow 33. The locking device 36 is then transferred by the thrust piece 26 to the releasing position in which the thrust piece 26 occupies a position displaced toward the tool 62, compared with FIG. 1. As a result, the pressure piece 26 is urged against the clamping pieces 40 so that the latter give way radially to the outside, getting into contact with the ejector 56, to leave the toothing 50 with the result that the securing element 48 is released and can be withdrawn from the spindle tube 18 together with the split chuck 66.

Upon completion of the change of the tool 62, the unit comprising the securing element 48 and the split chuck 66 can be introduced again into the spindle tube 18 and can then be transferred to the clamping position by operation of the clamping lever 28.

Further, a spring element 54 in the form of a shaft washer is captured between the two oppositely arranged radial surfaces at the end of the recess 78 of the split chuck 66 and the conical section 53 of the securing element. That spring element 54 facilitates the operation of releasing the securing element 48 after a previous clamping operation for permitting the securing element 48 to be easily withdrawn in the releasing position.

The invention claimed is:

1. A power-driven hand tool comprising:

a hollow drive spindle for driving a tool, said drive spindle being configured to move oscillatingly about a longitudinal axis thereof;

a split chuck for fixing said tool on a retaining section of said drive spindle, said split chuck being configured for engaging a mounting opening of said tool in a form-locking way and for engaging an inner surface of said drive spindle in a form-locking way;

a securing element comprising a clamping shaft configured for insertion through said split chuck into said drive spindle;

a displacing assembly for displacing said securing element between a releasing position in which said securing element and said split chuck are free to be released from said drive spindle, and between a clamping position in which said securing element extends through said split chuck and is axially fixed within said drive spindle, said split chuck clamping against said retaining section of said drive spindle for securing said tool therebetween;

a spring element biasing said displacing assembly into said clamping position; and a lock assembly received inside said drive spindle between said displacing assembly and said split chuck for locking said clamping shaft against retraction in said clamping position and for releasing said clamping shaft allowing retraction from said drive spindle in said releasing position;

wherein said lock assembly further comprises a sleeve and a plurality of clamping pieces held by said sleeve radially displaceably against said clamping shaft and axially displaceably within said drive spindle;

wherein said split chuck is releasable from said drive spindle together with said securing element when being in said releasing position.

2. A power-driven hand tool comprising:

a hollow drive spindle for driving a tool, said drive spindle being configured to move oscillatingly about a longitudinal axis thereof;

a split chuck for fixing said tool on a retaining section of said drive spindle, said split chuck being configured for engaging a mounting opening of said tool in a form-locking way and for engaging an inner surface of said drive spindle in a form-locking way;

a securing element comprising a clamping shaft configured for insertion through said split chuck into said drive spindle;

a displacing assembly for displacing said securing element between a releasing position in which said securing element and said split chuck are free to be released from said drive spindle, and between a clamping position in which said securing element extends through said split chuck and is axially fixed within said drive spindle, said split chuck clamping against said retaining section of said drive spindle for securing said tool therebetween; and a spring element biasing said displacing assembly into said clamping position;

wherein said split chuck is releasable from said drive spindle together with said securing element when being in said releasing position.

3. The hand tool of claim 2, further comprising a lock assembly received inside said drive spindle between said displacing assembly and said split chuck for locking said clamping shaft against retraction in said clamping position and for releasing said clamping shaft allowing retraction from said drive spindle in said releasing position.

4. The hand tool of claim 3, wherein said lock assembly further comprises a sleeve and a plurality of clamping pieces held by said sleeve radially displaceably against said clamping shaft and axially displaceably within said drive spindle.

5. The hand tool of claim 4, wherein said clamping pieces comprise first inclined surfaces, said first inclined surfaces engaging second inclined surfaces provided on said sleeve upon movement of said sleeve against said first inclined surfaces, thereby impinging said clamping pieces towards said clamping shaft for engaging said clamping shaft in said clamped position.

6. The hand tool of claim 5, wherein said displacement assembly comprising a thrust member configured for sliding said securing element between said releasing position and said clamping position.

7. The hand tool of claim 2, wherein said split chuck comprises at least one of a polygonal section and a curved section configured for form-locking engagement with said mounting opening of said tool.

8. The hand tool of claim 2, wherein said securing element comprises an outer conical section which is mated to an inner conical surface provided on said split chuck.

9. The hand tool of claim 2, wherein said split chuck comprises a form-locking element that is mated with a form-locking counter-element of said drive spindle.

10. The hand tool of claim 8, wherein a section of the securing element that engages said split chuck has a conical shape.

11. The hand tool of claim 2, further comprising a spring element arranged between said split chuck and said securing element.

12. The hand tool of claim 4, wherein said clamping shaft comprises form-locking elements at one end thereof, and wherein said clamping pieces are biased by said spring element toward said form-locking elements in a radial direction toward said longitudinal axis.

13. The hand tool of claim 4, further comprising first form-locking elements provided on said clamping shaft and second form-locking elements provided on said clamping pieces for engaging said clamping shaft form-lockingly in said clamped position.

14. The hand tool of claim 4, wherein said clamping pieces are retained in recesses of said sleeve.

15. The hand tool of claim 4, wherein said sleeve is axially biased by said spring element toward said clamping position.

16. The hand tool of claim 4, further comprising an ejector configured as a second sleeve, is provided within said drive spindle fixed in axial direction against movement toward said tool, for limiting any axial movement of said clamping pieces toward said tool.

17. A power-driven hand tool comprising:

a hollow drive spindle for driving a tool, said drive spindle being configured to move oscillatingly about a longitudinal axis thereof;

a split chuck for fixing said tool on a retaining section of said drive spindle, said split chuck being configured for engaging a mounting opening of said tool in a form-locking way and for engaging an inner surface of said drive spindle in a form-locking way;

a securing element comprising a clamping shaft configured for insertion through said split chuck into said drive spindle;

a displacing assembly for displacing said securing element between a releasing position in which said securing element and said split chuck are free to be released from said drive spindle, and between a clamping position in which said securing element extends through said split chuck and is axially fixed within said drive spindle, said split chuck clamping against said retaining section of said drive spindle for securing said tool therebetween;

a spring element biasing said displacing assembly into said clamping position; and a lock assembly received inside said drive spindle between said displacing assembly and said split chuck for locking said clamping shaft against retraction in said clamping position and for releasing said clamping shaft allowing retraction from said drive spindle in said releasing position;

wherein said lock assembly further comprises a sleeve and a plurality of clamping pieces held by said sleeve radially displaceably against said clamping shaft and axially displaceably within said drive spindle; and wherein said split chuck comprises at least one of a polygonal section and a curved section configured for form-locking engagement with said mounting opening of said tool;

wherein said split chuck is releasable from said drive spindle together with said securing element when being in said releasing position.

18. The hand tool of claim 17, wherein said securing element comprises an outer conical section which is mated to an inner conical surface provided on said split chuck.

19. The hand tool of claim 18, wherein said split chuck comprises a form-locking element that is mated with a form-locking counter-element of said drive spindle.

20. The hand tool of claim 1, wherein said securing element comprises an outer conical section which is mated to an inner conical surface provided on said split chuck.

* * * * *